US007467689B1

(12) United States Patent
Batten, Jr. et al.

(10) Patent No.: US 7,467,689 B1
(45) Date of Patent: Dec. 23, 2008

(54) METHOD FOR PNEUMATICALLY REMOVING OIL FROM AN ENGINE

(75) Inventors: Cyril J. Batten, Jr., Stillwater, OK (US); Duane Harding, Stillwater, OK (US); Joshua K. English, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 612 days.

(21) Appl. No.: 10/898,747

(22) Filed: Jul. 26, 2004

(51) Int. Cl.
*F16C 3/14* (2006.01)
*F16N 33/00* (2006.01)

(52) U.S. Cl. ..... 184/1.5

(58) Field of Classification Search ..... 184/1.5; 123/196 R, 196 CP, 196 A
See application file for complete search history.

(56) References Cited

U.S. PATENT DOCUMENTS

| | | | | | |
|---|---|---|---|---|---|
| 4,169,432 | A * | 10/1979 | White | 123/41.86 |
| 4,285,360 | A * | 8/1981 | Bauer | 137/205 |
| 4,884,660 | A | 12/1989 | Bedi | 184/1.5 |
| 5,002,154 | A | 3/1991 | Chen | 184/1.5 |
| 5,044,334 | A | 9/1991 | Bedi | 123/196 R |
| 5,070,831 | A | 12/1991 | Yunick | 123/196 A |
| 5,074,380 | A | 12/1991 | Bedi et al. | 184/1.5 |
| 5,190,120 | A * | 3/1993 | Watts | 184/1.5 |
| 5,246,086 | A | 9/1993 | Yunick | 184/1.5 |
| 5,494,012 | A | 2/1996 | Hagen | 123/196 S |
| 5,522,475 | A * | 6/1996 | Thompson | 184/1.5 |
| 5,682,851 | A * | 11/1997 | Breen et al. | 123/196 A |
| 5,787,372 | A * | 7/1998 | Edwards et al. | 701/29 |
| 6,050,295 | A | 4/2000 | Meisinger et al. | 137/541 |
| 6,123,174 | A * | 9/2000 | Elkin et al. | 184/1.5 |
| 6,213,173 | B1 | 4/2001 | Bedi et al. | 141/65 |
| 6,227,332 | B1 | 5/2001 | Liao | 184/1.5 |
| 6,321,874 | B1 * | 11/2001 | Miyamoto | 184/1.5 |
| 6,378,657 | B2 * | 4/2002 | Viken | 184/1.5 |
| 6,604,557 | B2 * | 8/2003 | Awad | 141/65 |
| 6,772,802 | B2 * | 8/2004 | Few | 141/65 |
| 6,772,803 | B2 * | 8/2004 | Awad | 141/65 |
| 6,779,633 | B2 * | 8/2004 | Viken | 184/1.5 |
| 6,886,606 | B2 * | 5/2005 | Few et al. | 141/65 |
| 6,896,014 | B1 * | 5/2005 | Bedi | 141/65 |
| 6,902,038 | B2 * | 6/2005 | Takahara | 184/1.5 |
| 2003/0079943 | A1 * | 5/2003 | Suratt | 184/1.5 |
| 2003/0094588 | A1 * | 5/2003 | Chen | 251/144 |
| 2004/0159495 | A1 * | 8/2004 | Erwin et al. | 184/1.5 |
| 2005/0189033 | A1 * | 9/2005 | Buchanan | 141/65 |

* cited by examiner

*Primary Examiner*—Robert A Siconolfi
*Assistant Examiner*—Thomas W Irvin
(74) *Attorney, Agent, or Firm*—William D. Lanyi

(57) ABSTRACT

Positive pressure is used to induce the flow of a liquid lubricant from a crankcase and through a drain conduit so that used oil can be removed from the engine and collected in a container during an oil change procedure. Positive pressure is introduced into the crankcase, and into an ullage region above the liquid lubricant, by the use of an inlet valve that can be attached to a cam cover to replace a PCV valve temporarily during the oil change.

31 Claims, 3 Drawing Sheets

METHOD FOR PNEUMATICALLY REMOVING OIL FROM AN ENGINE

BACKGROUND OF THE INVENTION

1. Field of the Invention

The present invention is generally related to a method for removing oil from an engine and, more particularly, to a method by which pressure within a crankcase of an engine is increased to induce a flow of used oil from the crankcase, in an upward direction, through a drain conduit.

2. Description of the Prior Art

Changing engine oil in a marine propulsion system application can sometimes be difficult because the oil drain plug is located at a bottom portion of the engine within the bilge of a marine vessel. This location and the restricted space surrounding the drain plug can often create significant difficulty in locating and maintaining a receptacle in a proper position to receive oil that is drained from the engine. It is also difficult to remove the filled receptacle that can contain a significant amount of used oil that has been removed from the engine. If a pump is used to draw the used oil out of the engine, the pump and all associated hoses must be cleaned after each use. If a tube is inserted into the oil level check tube, or "dipstick tube", the hose must have a sufficient wall thickness to resist collapsing under an internal vacuum caused by the pump. This is particularly troublesome if the oil is cold and highly viscous.

U.S. Pat. No. 4,884,660, which issued to Bedi on Dec. 5, 1989, describes a process for simple and high speed oil change and crankcase flushing in an internal combustion engine. The engine has a crankcase and movable parts. Oil pans are modified to include a through bore and an appropriate associated coupling member. The oil change process includes the steps of attaching an oil change conduit to the coupling member, spraying a flushing fluid under pressure through the fuel spray assembly and the fill hose into the oil pan, removing the spent oil through the suction hose, introducing the flushing fluid into the oil pan, removing the introduced flushing fluid through the suction hose, introducing fresh motor oil into the oil pan through the fill-spray assembly, and removing the oil change conduit from the coupling member.

U.S. Pat. No. 5,002,154, which issued to Chen on Mar. 26, 1991, describes a structure of portable oil sump residual engine oil suction pump device. A portable oil sump residual engine oil suction pump device comprises an oil reservoir having received therein a pump body to change the inner space of the oil reservoir into a negative pressure status so as to efficiently induce residual engine oil from an oil sump into the oil reservoir. A floating choke valve is fastened inside the oil reservoir at an upper position, which follows the filling of certain quantity of engine oil in the oil reservoir to block up a passage way to the pump body so as to stop the formation of vacuum and prohibit from entering of engine oil in the pump body.

U.S. Pat. No. 5,044,334, which issued to Bedi on Sep. 3, 1991, describes a process for clean and simple high speed oil change. The device includes an oil filter adapted to be positioned in the oil filter boss, a remote oil filter mounting boss and inlet and outlet hoses connecting the two. The device is attached to the engine. Suitable pump-out and fill lines are connected to the device and can be releasably attached to an external pump device. When the device is employed to change oil, the external pump device is connected, and spent oil removed from the oil pan under suction force through the pump-out line.

U.S. Pat. No. 5,070,831, which issued to Yunick on Dec. 10, 1991, describes an oil change system and method. An internal combustion engine oil change system includes an oil filter equipped with a check valve fill fitting. During an oil change, new oil is supplied to the engine through the check valve fitting, thus both filling the filter with oil and back flushing the engine's oil pump. An oil supply mechanism including a tank adapted to hold an appropriate pre-measured quantity of oil under pressure is provided.

U.S. Pat. No. 5,074,380, which issued to Bedi et al. on Dec. 24, 1991, describes a method and apparatus for changing oil in an internal combustion engine. The method is for removal of spent oil from an oil pan reservoir of an internal combustion engine and includes a flexible tube engageable through the dipstick sleeve of the engine. In a preferred embodiment, a vacuum pump is used to draw vacuum within a receptacle to thereby draw spent oil from the oil pan reservoir of the engine through the tube for temporary storage and transportation in an environmentally safe manner.

U.S. Pat. No. 5,246,086, which issued to Yunick on Sep. 21, 1993, describes an oil change system and method. An oil filter is supplied with a check valve fitting. During an oil change, new oil is supplied to the engine through the check valve fitting, thus both filling the filter with oil and back flushing the engine's oil pump.

U.S. Pat. No. 5,494,012, which issued to Hagen on Feb. 27, 1996, describes a pre-oiler. The system for automatically injecting oil into the oil gallery lubricating system of an automotive engine prior to start up is described. The assembly includes an outer vessel, a manifold valve block, which is attached to the outer vessel and includes a solenoid valve, and a control circuit for logic control of the solenoid valve. An air replenishment assembly is positioned on the outer vessel permitting measurement of the pressure in the outer vessel and also allowing for air to be added to the outer vessel to pressurize oil contained within the outer vessel. In one embodiment, the air replenishment assembly includes a Schrader valve which provides replacement air to the outer vessel and the spare tire. Oil is automatically injected into the oil gallery lubricating system upon the engine starting. Specifically, the solenoid valve is opened in response to the engine being started which allows pressurized oil to flow from the outer vessel to the oil gallery of the engine.

U.S. Pat. No. 6,050,295, which issued to Meisinger et al. on Apr. 18, 2000, describes a high flow valved fitting. The fitting is provided which includes a body having a first end and a second end spaced from the first end, with a fluid passage extending through the body between the first and second ends. A valve seat is defined in the body within the fluid passage, and a valve assembly is removably disposed within the fluid passage for controlling flow through the fluid passage.

U.S. Pat. No. 6,277,332, which issued to Liao on May 8, 2001, describes a structure for changing old engine oil in transmission case by automatic circulation mechanism. A structure for changing engine oil in the transmission case of the engine of a motor vehicle comprises a low pressure oil cylinder and a high pressure automatic throttle valve. The change of engine oil is obtained by an engine changing loop of the automatic circulation system.

U.S. Pat. No. 6,213,173, which issued to Bedi et al. on Apr. 10, 2001, describes an engine air purge apparatus and method. An apparatus for changing oil in a vehicle having an internal combustion engine with lubricating passages, the apparatus has a system for air purging the lubrication passages to expediently remove the oil. The apparatus includes a pressure transducer in the fluid line of the air purge system to monitor a pressure drop of the compressed air when the spent oil has been removed from the engine. When the pressure drop exceeds a predetermined value the air purge system automatically deactivates.

U.S. Pat. No. 6,390,149, which issued to Arbey et al. on May 21, 2002, describes a device for emptying a container of a viscous fluid. Devices for emptying a container of viscous fluid in an ambient medium where there exists an atmosphere under pressure and a force of gravity is described. The device of the invention is essentially characterized by the fact that it comprises a receptacle having a main volume comprising top and bottom portions in which a separation wall defines two secondary volumes, an orifice made through the wall to put the two secondary volumes into communication, and opening out into the secondary volume in the top portion of the main volume, a pump mounted to cooperate with the receptacle, its suction inlet being in the volume and its outlet opening out to the outside of the receptacle, a tube, and means for mounting the tube in association with the receptacle so that its outlet opening is situated in the secondary volume and its inlet opening lies outside the receptacle. The invention is particularly applicable to changing engine oil in motor vehicles or the like.

The patents described above are hereby expressly incorporated by reference in the description of the present invention.

It would be beneficial if a method could be provided for removing used oil from an engine without requiring the use of a suction to draw the oil out of its oil reservoir, or crankcase, and without the need for passing the used oil through pumps and associated devices which require cleaning after use.

SUMMARY OF THE INVENTION

A method for removing lubricant from an engine, according to a preferred embodiment of the present invention, comprises the steps of providing a drain conduit connected in fluid communication with a lubricant reservoir of the engine, pressurizing the lubricant reservoir, and conducting the lubricant from the lubricant reservoir. The pressurizing step can comprise the step of introducing a gas into an ullage region of the lubricant reservoir, such as through an inlet valve. The pressurizing step can also comprise the steps of replacing a positive crankcase ventilation (PCV) valve with the inlet valve and then introducing the gas into the lubricant reservoir through the inlet valve. The inlet valve can further comprise a pressure relief valve which is configured to limit pressure within the lubricant reservoir to a preselected maximum magnitude. The inlet valve can comprise a Schrader valve. The drain conduit, in a preferred embodiment of the present invention, can be insertable into a tube (e.g. the "dipstick" tube) extending from an internal cavity of the lubricant reservoir and the tube can be sealable to prevent the gas from passing between an outer surface of the drain conduit and an inner surface of the tube. The drain conduit can be removably attached in fluid communication with the lubricant reservoir at a location other than in association with the tube.

In a preferred embodiment of the present invention, the lubricant reservoir is a crankcase of the engine and the pressurizing step can be performed by a manually operated air pump, such as a bicycle tire pump. The pressurizing step can comprise the step of introducing the gas through an opening in a valve cover of the engine. The drain conduit is preferably connected to a bottom portion of the lubricant reservoir, or crankcase. The drain conduit can comprise an inlet end and an outlet end. The inlet end is disposed near the bottom portion of the lubricant reservoir and the outlet end is disposed at a location above the inlet end. The inlet end of the drain conduit is disposed within a pool of liquid lubricant in the bottom portion of the lubricant reservoir in a preferred embodiment of the present invention.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
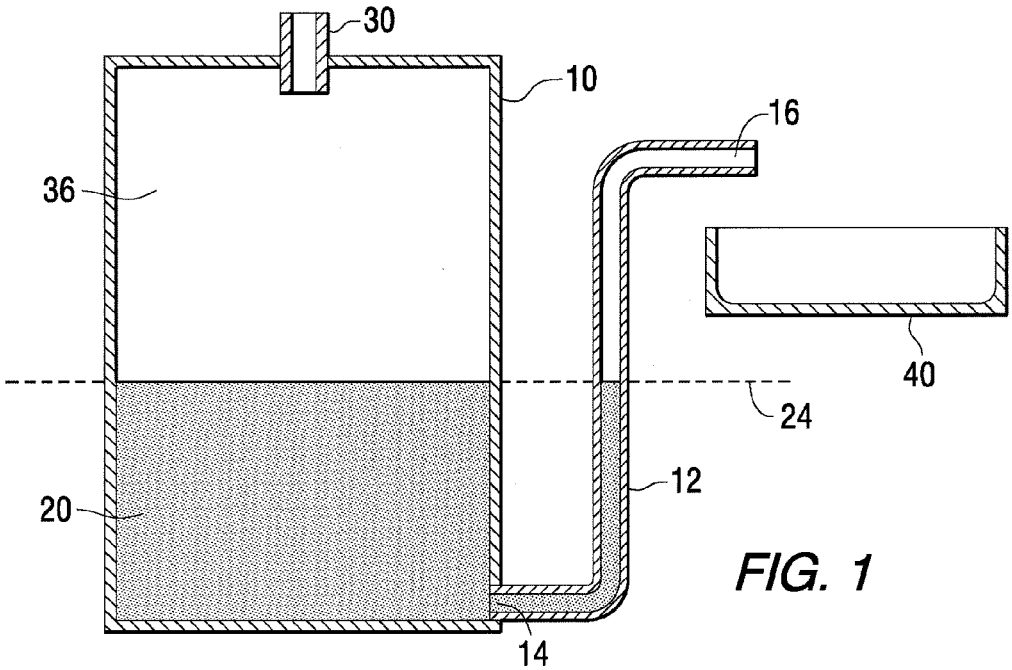
FIGS. 1 and 2 are simplified representations of a lubricant reservoir to illustrate the concepts of the present invention.

Throughout the description of the preferred embodiment of the present invention, like components will be identified by like reference numerals.

Figure 2:
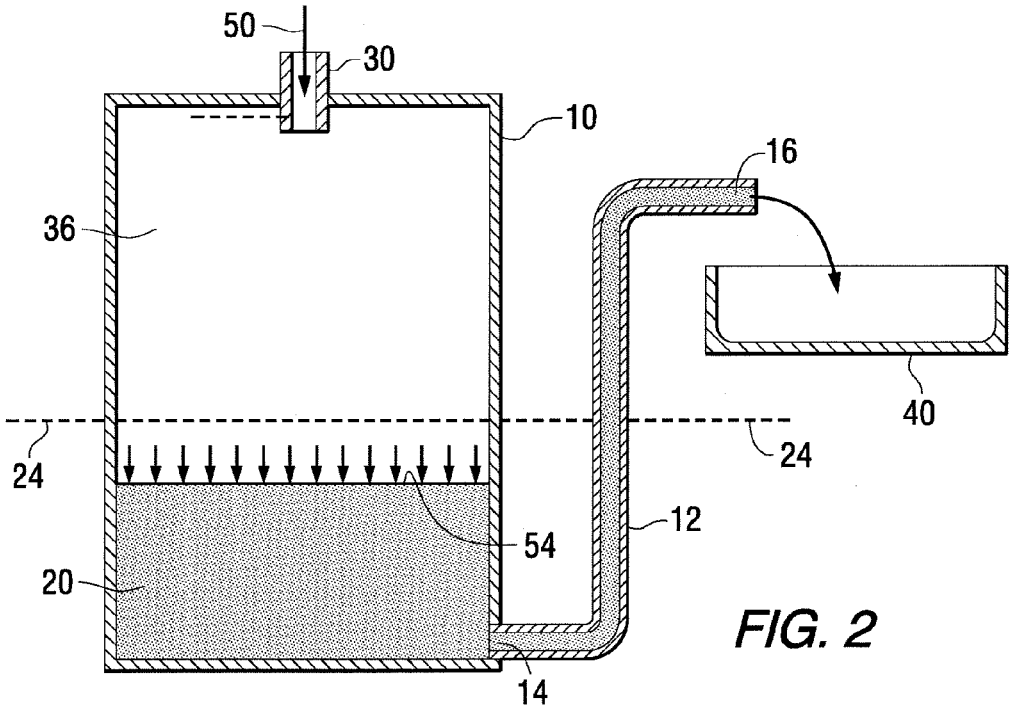

FIGS. 1 and 2 are schematic representations of a lubricant reservoir that are provided to describe the basic concepts of the present invention. FIG. 1 shows the lubricant reservoir 10 with a drain conduit 12 connected in fluid communication with the lubricant reservoir 10. More specifically, an inlet end 14 of the drain conduit 12 is disposed near a bottom portion of the lubricant reservoir 10 and an outlet end 16 of the drain conduit 12 is disposed at a location above the inlet end 14. The inlet end 14 is disposed within a pool of liquid lubricant 20 in the bottom portion of the lubricant reservoir 10. Dashed line 24 represents the upper level of the liquid lubricant. As can be seen, the level 24 of the liquid lubricant 20 within the main volume of the lubricant reservoir 10 is generally equal to the level of the liquid lubricant within the drain conduit 12. An inlet valve 30 is provided at an upper portion of the lubricant reservoir 10 and, in a preferred embodiment of the present invention, in direct fluid communication with an ullage region 36 of the lubricant reservoir 10. An exemplary container 40 is provided to collect used liquid lubricant when it is removed from the lubricant reservoir 10.

FIG. 2 is generally similar to FIG. 1, but illustrates the lubricant reservoir 10 when a pressurized gas is introduced through the inlet valve 30, as represented by arrow 50. This introduction of gas through the inlet valve 30, and into the ullage region 36 of the lubricant reservoir 10, increases the pressure within the lubricant reservoir and provides a resulting downward force on the upper surface 54 of the liquid lubricant 20. This causes the liquid lubricant 20 to be pushed downward and through the drain conduit 12. This is represented by the fact that the upper level 54 of the liquid lubricant 20 is moved downwardly from dashed line 24 and from its position shown in FIG. 1 prior to the imposition of pressure into the ullage region 36. The pressure provides the downward force on the liquid lubricant 20 which induces its flow into the inlet end 14, through the drain conduit 12, and out of the outlet end 16 to be caught and retained by the receptacle 40.

It should be understood that the present invention does not intentionally place the internal cavity of the lubricant reservoir 10 under a vacuum at any time. The pressure within the ullage region 36 is not intentionally reduced below atmospheric pressure. In addition, it can be seen that the present invention does not draw oil out of the lubricant reservoir 10 through the use of a pump or other associated equipment which would otherwise have to be cleaned after the removal of the used lubricant from the lubricant reservoir.

Figure 3:
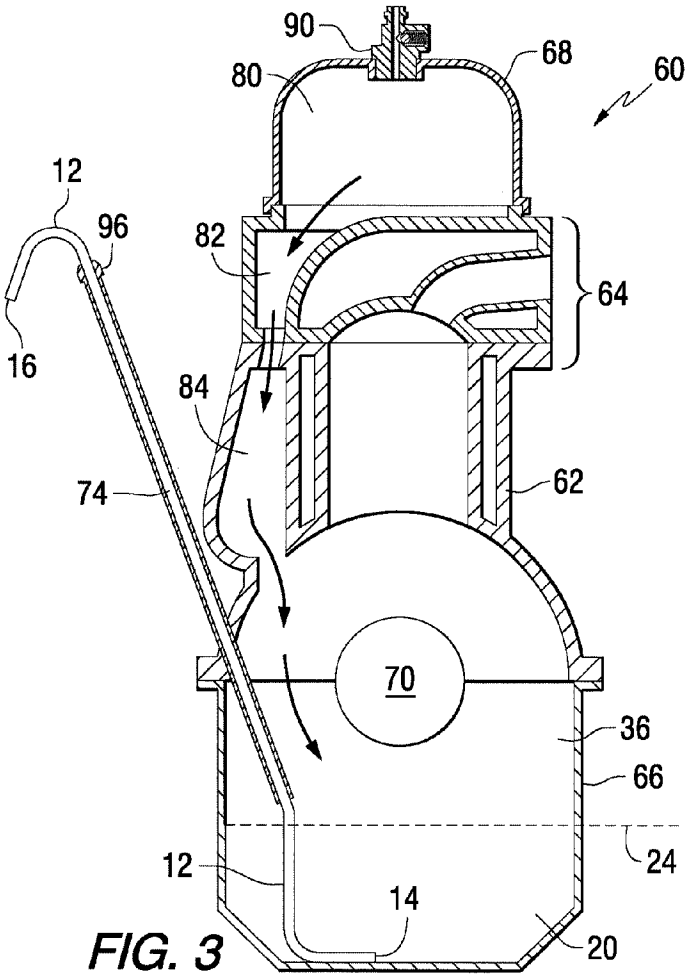
FIG. 3 shows one embodiment of the present invention.

FIG. 3 is a section view of an engine 60 with an engine block 62 and a head portion 64. A crankcase 66 is supported from the block 62 and a cam cover 68 is located on the head 64. A crank shaft 70 is shown in FIG. 3. An oil level inspection tube 74, which is commonly referred to as a "dipstick tube", is shown extending into the lubricant reservoir portion in the bottom region of the crankcase 66. A pool of liquid lubricant 20 is stored in the lower region of the lubricant reservoir. In FIG. 3, the lubricant reservoir is the crankcase 66. Functionally, this is similar to the lubricant reservoir identified by reference numeral 10 in FIGS. 1 and 2.

With continued reference to FIG. 3, several cavity regions are identified. A space 80 exists under the cam cover 68. A passage 82 is in fluid communication with the space 80 and another passage 84 is in communication with the passage 82. This arrangement allows oil to flow, under the influence of gravity, into the pool of liquid lubricant 20 at the bottom portion of the lubricant reservoir, or crankcase 60.

An inlet valve 90 is located at the upper portion of the engine and provides a passage through a wall of the cam cover 68. The inlet valve 90 will be described in greater detail below in conjunction with FIG. 5. When air, or another gas, is introduced through the inlet valve 90 and into the space under the cam cover 68, this introduction can raise the pressure within the space 80 and passages 82 and 84. This in turn, raises the pressure in the ullage region 36 of the crankcase 66. The embodiment of the present invention shown in FIG. 3 provides a drain conduit 12 that extends downwardly through the oil level check tube 74 as shown. A sealing portion 96 is provided to prevent a flow of gas between the outer surface of the drain conduit 12 and the inner surface of the tube 74. The drain conduit 12, in this embodiment of the present invention shown in FIG. 3, is inserted downwardly through the tube 74 to place its inlet end 14 within the pool of liquid lubricant 20. The outlet end 16 of the drain conduit 12 extends out of the tube 74. When the ullage region 36 is pressurized by causing a gas to flow through the inlet valve 90, the liquid lubricant 20 is forced into the inlet end 14 of the drain conduit 12 and out of the crankcase 66. When the liquid lubricant flows out of the outlet end 16, it can be collected in a containment such as the containment 40 described above in conjunction with FIGS. 1 and 2.

Figure 4:
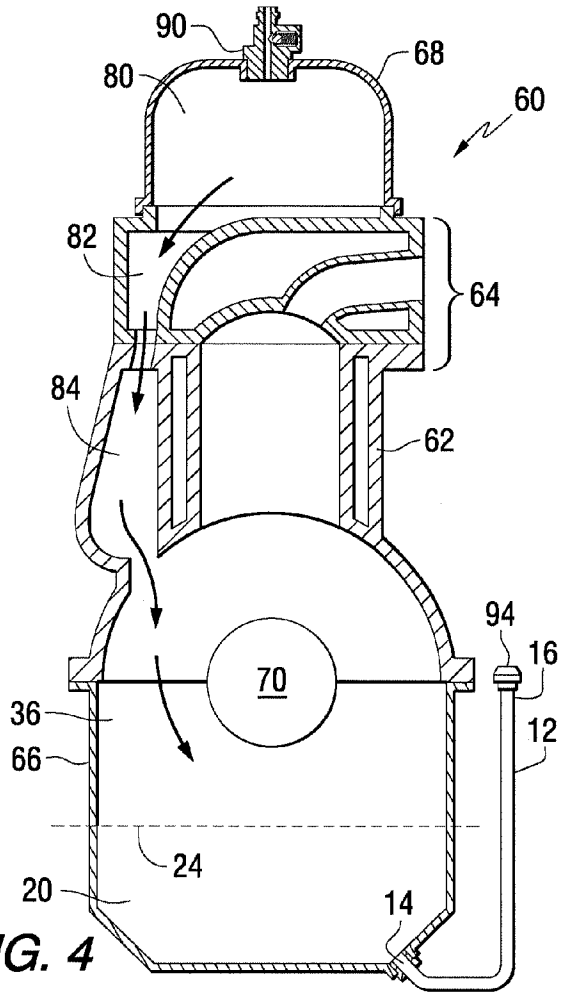
FIG. 4 shows a second embodiment of the present invention.

FIG. 4 shows a different embodiment of the present invention. The drain conduit 12 is more permanently affixed to the crankcase 66, or lubricant reservoir, and can remain attached to the engine 60. The operation of the other components are similar to that described above in conjunction with FIG. 3. The differences between FIGS. 3 and 4 are that the drain conduit 12 in FIG. 4 is intended to be attached to the lubricant reservoir, or crankcase 66, whereas the drain conduit 12 in FIG. 3 is temporarily inserted into and through the tube 74 and later removed after the liquid lubricant 20 has been removed from the crankcase 66.

Figure 5:
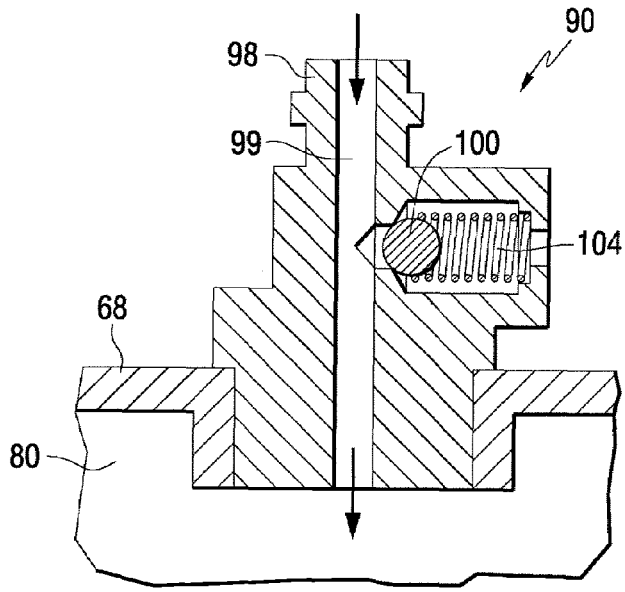
FIG. 5 is a section view of an inlet valve used in conjunction with the present invention.

FIG. 5 is a detailed view of the inlet valve 90. A fitting is intended to be attached to the upper end 98 to allow air or another suitable gas to be pumped into the passage identified by reference numeral 99. A check valve is provided which, in the embodiment shown in FIG. 5, comprises a ball 100 and a resilient member 104. If the pressure within the passage 99 exceeds a preselected threshold, the ball 100 will be moved toward the right in FIG. 5 against the force of the spring 104 to relieve the pressure in the passage 99. This is intended to provide a mechanism to prevent pressure in the ullage region 36 from exceeding a magnitude that could otherwise cause damage to components of the system. In other words, certain seals might be damaged if excessive pressure is introduced into the crankcase 66. This is particularly possible if, during cold weather, the liquid lubricant 20 becomes extremely viscous. This would allow the viscous liquid lubricant to cause a back pressure within the ullage region 36 that could exceed an appropriate magnitude and cause damage to certain components of the engine structure if additional gas is pumped into the spaces above the liquid lubricant 20. Although the check valve is not required in all embodiments of the present invention, it provides a useful service in avoiding damage in the circumstance where additional pressure is provided even though the liquid lubricant is not flowing through the drain conduit 12.

In FIG. 4, a plug 94 is shown inserted into the outlet end 16 of the drain conduit 12. This plug is provided in the event that the drain conduit 12 remains as a permanent fixture of the crankcase 66.

Figure 6:
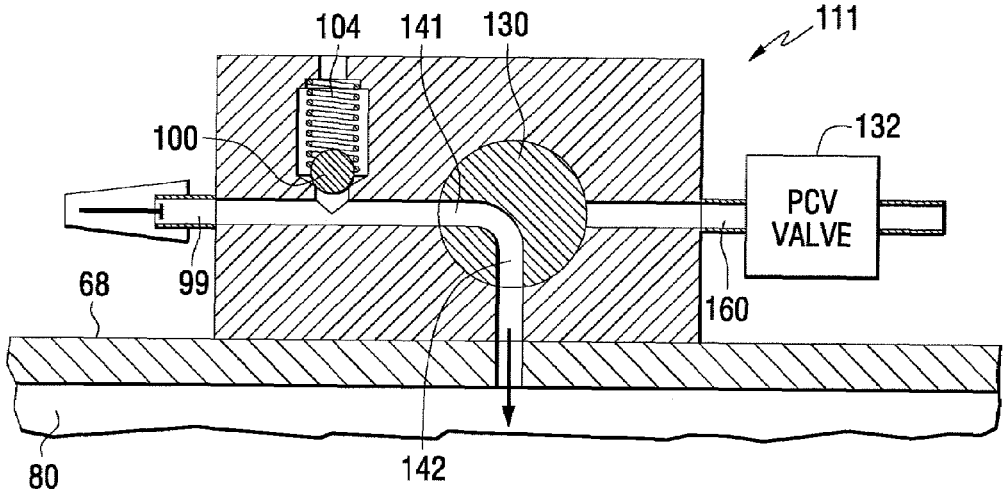
FIG. 6 is a highly schematic representation of a combination valve which allows the use of the present invention without the necessity of removing the PCV valve.

FIG. 6 is a highly schematic representation of an alternative embodiment of the present invention in which the inlet valve 90 is provided with a valve 110 that allows the inlet valve 90 to remain in place even when oil is not being changed. The embodiments described above in conjunction with FIGS. 3 and 4 would normally replace a positive crankcase ventilation (PCV) valve with the inlet valve 90 when the liquid lubricant 20 is to be removed from the crankcase 66. After the removal of the liquid lubricant 20, the inlet valve 90 would be replaced with the PCV valve for normal operation of the engine 60. The adaptation of the present invention shown in FIG. 6 would make that replacement unnecessary.

In FIG. 6, a combination valve is shown schematically. The purpose of the combination valve is to allow the PCV valve 132 to remain in place while the operator removes the used oil 20 from the crankcase, as described above in conjunction with FIGS. 3 and 4. The elements of the inlet valve 90, illustrated in FIG. 5, are combined with a rotatable valve member 130 and a PCV valve 132 to form a combination valve 111. The combination valve 111 is attachable to the valve cover 68 and provides two alternative fluid paths that are both connected to the space 80 under the valve cover 68. It should be understood that the combination valve 111 is illustrated in a highly schematic way in FIG. 6 to show the combined functions performed by the combination valve 111. The rotatable valve member 130 is provided with a channel that has two passages, 141 and 142. When rotated to the position shown in FIG. 6, passage 141 is connected in fluid communication with passage 99 which is described above in conjunction with FIG. 5. A Schrader valve 150 is shown connected to passage 99 in FIG. 6. This valve allows a quick and simple way to provide air pressure into passage 99. With the rotatable valve 130 in the position shown in FIG. 6, this air flow continues through passage 142 and into the space 80 under the valve cover 68. This pressurizes the ullage region 36 in the crankcase, as described above in conjunction with FIGS. 3 and 4. If the rotatable valve 130 is rotated 90 degrees about its center, in a counterclockwise direction, passage 141 is moved into fluid communication with the space 80 under the valve cover 68 and passage 142 is moved into communication with conduit 160 and the PCV valve 132. Therefore, the schematic representation shown in FIG. 6 illustrates that a valve can use a rotatable member 130 to alternatively connect the inlet valve portion of the combination valve 111 to the ullage region 36 of the crankcase or, alternatively, it can connect the PCV valve 132 to the ullage region 36. It should be understood that FIG. 6 is intentionally represented in a highly schematic manner to illustrate the basic functions of the combination valve 111. Alternative devices can be configured to perform this similar function. In addition, a Schrader valve 150 is not necessary in all applications and embodiments of the present invention.

With reference to FIGS. 1-6, it can be seen that a method for removing lubricant 20 from an engine 60, in a preferred embodiment of the present invention, comprises the steps of providing a drain conduit 12 connected in fluid communication with a lubricant reservoir, 10 or 66, of the engine 60. It also comprises the steps of increasing the pressure within the lubricant reservoir to a magnitude which is sufficient to cause a liquid lubricant 20, or engine oil, to rise up in the drain conduit 12 to a sufficient height to flow out of the outlet end 16 of the drain conduit 12 and into a container. A liquid lubricant is conducted from the lubricant reservoir by the drain conduit 12. The pressurizing step can comprise the step of introducing a gas into an ullage region 36 of the lubricant reservoir and, more particularly, it can comprise the step of introducing the gas through an inlet valve 90. This pressurizing step, or pressure increasing step, can comprise the steps of replacing a PCV valve 132 with the inlet valve 90.

In the description of the preferred embodiments of the present invention, the term "pressurizing" has been used in conjunction with the effect produced through the use of the inlet valve 90. The purpose of the pressurizing step is to increase the pressure in the lubricant reservoir to a magnitude that is sufficient to cause the liquid lubricant 20 to rise upward through the drain conduit 12. Depending on the position and configuration of the drain conduit 12, the pressurizing step, or step of increasing the pressure within the crankcase 66, can be accomplished by overcoming atmospheric pressure and the pressure resulting from a pressure head caused by the position of the outlet end 16 of the drain conduit 12.

Although the present invention has been described with particular specificity and illustrated to show a particularly preferred embodiment, it should be understood that alternative embodiments are also within its scope.

We claim:

1. A method for removing lubricant from an engine, comprising the steps of: providing a drain conduit connected in fluid communication with a lubricant reservoir of said engine, a submerged end of said drain conduit being disposed in a bottom portion of said lubricant reservoir; manually increasing the pressure of said lubricant reservoir, said pressure increasing step comprising the step of introducing a gas into said lubricant reservoir through an inlet valve to induce said lubricant to flow into said submerged end of said drain conduit and through the length of said drain conduit; providing said inlet valve with first and second alternative fluid paths connected to said lubricant reservoir; providing said inlet valve with a movable valve member movable between a first position connecting said first fluid path to said lubricant reservoir, and a second position connecting said second fluid path to said lubricant reservoir; moving said movable valve member between said first and second positions; performing said step of increasing the pressure of said lubricant reservoir by moving said movable valve member to said first position; providing said movable valve member as a rotatable valve member; providing said rotatable valve member with first and second channel passages; rotating said rotatable valve member to said first position to align said first channel passage and said first fluid path to pass fluid therebetween; and rotating said rotatable valve member to said second position to align said second channel passage and said second fluid path to pass fluid therebetween; and conducting said lubricant from said lubricant reservoir, wherein: said drain conduit is insertable into a tube extending from an internal cavity of said lubricant reservoir and said tube is sealable to prevent said gas from passing between an outer surface of said drain conduit and an inner surface of said tube.

2. The method of claim 1, wherein:

said pressure increasing step comprises the step of introducing a gas into an ullage region of said lubricant reservoir.

3. The method of claim 1, wherein:

said inlet valve comprises a pressure relief valve.

4. The method of claim 3, wherein:

said pressure relief valve is configured to limit pressure within said lubrication reservoir to a preselected maximum magnitude.

5. The method of claim 1, wherein:

said inlet valve further comprises a Schrader valve.

6. The method of claim 1, wherein:

said drain conduit is removably attached in fluid communication with said lubricant reservoir.

7. The method of claim 1, wherein:

said lubricant reservoir is a crankcase of said engine.

8. The method of claim 1, wherein:

said pressure increasing step is performed by a manually operated air pump.

9. The method of claim 1, wherein:

said pressure increasing step comprises the step of introducing a gas through an opening in a valve cover of said engine.

10. The method of claim 1, wherein:

said drain conduit comprises an inlet end and an outlet end, said inlet end being disposed near a bottom portion of said lubricant reservoir, said outlet end being disposed at a location above said inlet end.

11. The method of claim 10, wherein:

said inlet end of said drain conduit is disposed within a pool of liquid lubricant in said bottom portion of said lubricant reservoir.

12. A method for removing lubricant from an engine, comprising the steps of:

providing a drain conduit connected in fluid communication with a crankcase of said engine;

manually pressurizing said crankcase, said pressurizing step comprising the step of introducing a gas into an ullage region of said crankcase through an inlet valve;

providing said inlet valve with first and second alternative fluid paths connected to said lubricant reservoir;

providing said inlet valve with a movable valve member movable between a first position connecting said first fluid path to said lubricant reservoir, and a second position connecting said second fluid path to said lubricant reservoir;

moving said movable valve member between said first and second positions;

performing said step of pressurizing said crankcase by moving said movable valve member to said first position;

providing said movable valve member as a rotatable valve member;

providing said rotatable valve member with first and second channel passages;

rotating said rotatable valve member to said first position to align said first channel passage and said first fluid path to pass fluid therebetween; and rotating said rotatable valve member to said second position to align said second channel passage and said second fluid path to pass fluid therebetween; and conducting said lubricant from said crankcase through said drain conduit, wherein:

said drain conduit is connected to a bottom portion of said crankcase.

13. The method of claim 12, wherein:

said inlet valve comprises a pressure relief valve.

14. The method of claim 13, wherein:

said pressure relief valve is configured to limit pressure within said lubrication reservoir to a preselected maximum magnitude.

15. The method of claim 14, wherein:

said inlet valve further comprises a Schrader valve.

16. The method of claim 12, wherein:

said drain conduit is insertable into a tube extending from an internal cavity of said crankcase and said tube is sealable to prevent said gas from passing between an outer surface of said drain conduit and an inner surface of said tube.

17. The method of claim 12, wherein:

said drain conduit is removably attached in fluid communication with said crankcase.

18. The method of claim 12, wherein:

said pressurizing step is performed by a manually operated air pump.

19. The method of claim 12, wherein:

said pressurizing step comprises the step of introducing a gas through an opening in a valve cover of said engine.

20. The method of claim 12, wherein:

said drain conduit comprises an inlet end and an outlet end, said inlet end being disposed near a bottom portion of said crankcase, said outlet end being disposed at a location above said inlet end.

21. The method of claim 20, wherein:

said inlet end of said drain conduit is disposed within a pool of liquid lubricant in said bottom portion of said crankcase.

22. A method for removing lubricant from an engine, comprising the steps of:

providing a drain conduit connected in fluid communication with a lubricant reservoir of said engine;

manually pressurizing said lubricant reservoir by introducing a gas into an ullage region of said lubricant reservoir through an inlet valve;

providing said inlet valve with first and second alternative fluid paths connected to said lubricant reservoir;

providing said inlet valve with a movable valve member movable between a first position connecting said first fluid path to said lubricant reservoir, and a second position connecting said second fluid path to said lubricant reservoir;

moving said movable valve member between said first and second positions;

performing said step of pressurizing said lubricant reservoir by moving said movable valve member to said first position;

providing said movable valve member as a rotatable valve member;

providing said rotatable valve member with first and second channel passages;

rotating said rotatable valve member to said first position to align said first channel passage and said first fluid path to pass fluid therebetween;

rotating said rotatable valve member to said second position to align said second channel passage and said second fluid path to pass fluid therebetween;

providing said rotatable valve member with said first and second channel passages meeting at a junction such that:

in said first position of said rotatable valve member, fluid flows from said first fluid path through said first channel passage through said junction through said second channel passage to said lubricant reservoir; and in said second position of said rotatable valve member, fluid flows from said lubricant reservoir through said first channel passage through said junction through said second channel passage to said second fluid path; and conducting said lubricant from said lubricant reservoir, wherein:

said pressurizing step is performed by a manually operated air pump.

23. The method of claim 22, wherein:

said drain conduit is insertable into a tube extending from an internal cavity of said lubricant reservoir and said tube is sealable to prevent said gas from passing between an outer surface of said drain conduit and an inner surface of said tube.

24. The method of claim 22, wherein:

said drain conduit is removably attached in fluid communication with said lubricant reservoir.

25. The method of claim 22, wherein:

said inlet valve further comprises a Schrader valve.

26. The method according to claim 1, comprising providing said rotatable valve member with said first and second channel passages meeting at a junction such that:

in said first position of said rotatable valve member, fluid flows from said first fluid path through said first channel passage through said junction through said second channel passage to said lubricant reservoir; and in said second position of said rotatable valve member, fluid flows from said lubricant reservoir through said first channel passage through said junction through said second channel passage to said second fluid path.

27. A method according to claim 1, wherein said pressurizing step comprises the steps of replacing a PCV valve with said inlet valve and introducing said gas into said crankcase through said inlet valve.

28. The method of claim 12, comprising providing said rotatable valve member with said first and second channel passages meeting at a junction such that:

in said first position of said rotatable valve member, fluid flows from said first fluid path through said first channel passage through said junction through said second channel passage to said lubricant reservoir; and in said second position of said rotatable valve member, fluid flows from said lubricant reservoir through said first channel passage through said junction through said second channel passage to said second fluid path.

29. The method of claim 12, wherein said pressurizing step comprises the steps of replacing a PCV valve with said inlet valve and introducing said gas into said crankcase through said inlet valve.

30. The method of claim 22, wherein said drain conduit comprises an inlet end and an outlet end, said inlet end being disposed near a bottom portion of said lubricant reservoir, said outlet end being disposed at a location above said inlet end, said inlet end of said drain conduit being disposed within a pool of liquid lubricant in said bottom portion of said lubricant reservoir, said lubricant reservoir being a crankcase of said engine, said pressurizing step comprising the step of introducing a gas through an opening in a valve cover of said engine, said inlet valve comprising a pressure relief valve, said pressure relief valve being configured to limit pressure within said lubricant reservoir to a preselected maximum magnitude.

31. The method of claim 30, wherein said pressurizing step comprises the steps of replacing a PCV valve with said inlet valve and introducing said gas into said lubricant reservoir through said inlet valve.

* * * * *